US006349620B1

(12) United States Patent
Anderson

(10) Patent No.: US 6,349,620 B1
(45) Date of Patent: Feb. 26, 2002

(54) HINGED SOCKET WRENCH SPEED HANDLE

(76) Inventor: Steven P. Anderson, 6650 Reseda Blvd., 112, Reseda, CA (US) 91335

( * ) Notice: Subject to any disclaimer, the term of this patent is extended or adjusted under 35 U.S.C. 154(b) by 0 days.

(21) Appl. No.: 09/426,495

(22) Filed: Oct. 26, 1999

Related U.S. Application Data

(63) Continuation-in-part of application No. 09/302,547, filed on Apr. 30, 1999, now abandoned.

(51) Int. Cl.[7] ..... B25B 13/00
(52) U.S. Cl. ..... 81/73; 81/177.9
(58) Field of Search ..... 81/35, 73, 177.7, 81/177.9

(56) References Cited

U.S. PATENT DOCUMENTS 1,431,389 A * 10/1922 Frisz ..... 81/177.9
1,719,310 A * 7/1929 Rawlings ..... 81/177.9
1,835,315 A * 12/1931 McLay ..... 81/177.9
2,068,207 A * 1/1937 Torbert, Jr. ..... 81/177.9
3,882,753 A * 5/1975 Svenson ..... 81/177.7
4,334,445 A * 6/1982 Timewell ..... 81/177.7
5,279,189 A * 1/1994 Marino ..... 81/177.8
5,280,740 A * 1/1994 Ernst ..... 81/177.7
5,511,452 A * 4/1996 Edmonds ..... 81/73
5,943,925 A * 8/1999 Huang ..... 81/177.2

* cited by examiner

*Primary Examiner*—Joseph J. Hail, III
*Assistant Examiner*—David B. Thomas
(74) *Attorney, Agent, or Firm*—Albert O. Cota

(57) ABSTRACT

A hinged socket wrench for use with tool sockets which utilizes an offset shank (20) at bends of equal angles, which place the ends parallel with each other. A clevis (28) is formed into the shank at one end and a square drive head (30) is held in place within the clevis with a hinge pin (40), thus permitting a 180 degree rotation. The wrench secures a workpiece by spinning the offset handle in a circular direction and then pushed to a convenient position for tightening. The wrench may be used as a conventional flex handle by locking the drive head in an angular position in five equal increments by sliding the hinge pin (40) to the appropriate position. A second embodiment includes another head attached directly to both the handle (58) and an additional clevis which functions in the same manner as the square drive head however it adds further combinations of angular displacement of the speed handle increasing its value as a tool and also its productiveness in difficult work areas.

15 Claims, 4 Drawing Sheets

HINGED SOCKET WRENCH SPEED HANDLE

CROSS REFERENCE TO RELATED APPLICATION

This application is a continuation-in-part of application Ser. No. 09/302,547 filed Apr. 30, 1999 now abandoned.

TECHNICAL FIELD

The invention pertains to the general field of socket wrenches and more particularly to a speed handle for a socket wrench that has an offset shaft with a rotating handle and a lockable position square drive head.

BACKGROUND ART

Previously, socket wrenches equipped with various types of speed handles, or spreader wrenches, have been used to provide an effective means for producing a fast and easy method of rotating a threaded fastener using conventional sockets. The usual approach is to utilize an extended handle that is bent with four 90 degree bends with a rotating grip on one end and the offset parallel with the handle shaft. This configuration permits the user to grasp both the grip and offset portion simultaneously and rotate the tool rapidly, much like a crank handle or the brace and bit. Many combinations of handle offsets and multiple bends have been used in the past for sockets and screwdrivers, to employ the principle of rapid manual rotation by the shape of the tool handle.

A search of the prior art did not disclose any patents that read directly on the claims of the instant invention, however the following U.S. patents are considered related:

| U.S. Pat. No. | INVENTOR | ISSUED |
|---|---|---|
| 5,511,452 | Edmons | Apr. 30, 1996 |
| 5,280,740 | Ernst | Jan. 25, 1994 |
| 5,279,189 | Marino | Jan. 18, 1994 |
| 4,974,477 | Anderson | Dec. 4, 1990 |
| 4,909,104 | Mehlau, et al | Mar. 20, 1990 |
| 4,711,145 | Inoue | Dec. 8, 1987 |
| 4,541,310 | Lindenberger | Sep. 17, 1985 |
| 3,388,622 | Klang | Jun. 18, 1968 |
| 3,343,434 | Schroeder | Sep. 26, 1967 |
| 2,712,765 | Knight, Jr. | Jul. 12, 1955 |
| 2,577,931 | Tillman | Dec. 11, 1951 |
| 2,382,291 | Carlberg | Aug. 14, 1945 |
| 1,779,203 | Williamson | Oct. 21, 1930 |
| 1,775,402 | Mandl | Sep. 9, 1930 |
| 1,537,657 | Burch | May 12, 1925 |
| 460,256 | Stewart | Sep. 29, 1891 |

Edmons in U.S. Pat. No. 5,511,452 teaches a speed handle with a ratchet drive having an offset between the axis of the handle and that of the ratchet drive for tight places where there is little room for the handle. The balance of the speed handle is conventional much like those currently available.

U.S. Pat. No. 5,279,189 issued to Marino, has a pair of handles displaced longitudinally by a given distance, and a hinge connecting a coupling to an arm or one of the handles, permitting relative movement therebetween about a pivot axis normal to the rotational axis of the coupling.

Anderson's U.S. Pat. No. 4,974,477 is for a speed wrench using a S-curve shaped shank. The shank causes the axis of the tool to intersect the axis of the handle, thereby creating a cone-shaped pattern of rotation, which permits the user to rotate the tool's handle with wrist motion. clank in U.S. Pat. No. 3,388,622 discloses a speed wrench consisting of a pair of concentric, rotatively-connected members. One arm is radially offset from the common axis of concentricity relative to the outer member such that cranking of the handle rotates a work engaging arm.

U.S. Pat. No. 2,712,765 issued to Knight, Jr. is for a wrist motion hand tool having a shaft with a pair of bends having a slight longitudinal or axial displacement in the bore of a pistol-grip shaped handle. The wrist motion of the user rotates the crank arm and only one hand is required to rotate the workpiece.

Stewart's U.S. Pat. No. 460,256 teaches a handle for a rotary tool using a pair of bends in a shaft, that form a diagonal wrist. An anti-friction sleeve is added to the handle for ease of rotation.

For background purposes and as indicative of the art to which the invention relates reference may be made to the patents issued to Ernst, Mehlau, et al, Inoue, Lindenberger, Schroeder, Tillman, carlsberg, Williamson, Mandl and Burch.

DISCLOSURE OF THE INVENTION

In today's economy manpower is expensive and any tool or device that can reduce the time spent accomplishing a given task is of extreme importance. Therefore, the primary object of the invention is to provide a hand tool that can be utilized with most popular socket sets, and that shortens the time required to attach or remove a threaded fastener with a polygon-shaped or other configured head on the screw, bolt or nut. Normally, a ratchet handle is connected to a socket and ratcheted by radial motion with one hand while being held in place with the other hand. The instant invention permits a user to rapidly rotate the nut or bolt until it starts to tighten. The rapid rotation is accomplished by simple wrist action with considerably more speed than a conventional ratchet handle. By testing, it was determined that by using the instant invention, the tightening of a fastener, or the removal of a fastener, after its initial loosening, was four to five times faster than accomplished previously.

Further, it is an important object of the invention to initially loosen or finally tighten the fastener by simply repositioning the handle at a suitable angle to gain the maximum amount of torque. This repositioning is provided in a 180 degree arc by a rotatable drive head that permits the socket to remain on the workpiece and the handle to be moved to a convenient Position like a standard breaker bar or flex handle. As the invention is relatively short and compact, the user may shift from a vertical position to a 45 or 90 degree angle in almost one continuous motion. This allows the user to maintain absolute control of the socket upon the workpiece and to continue adding torque until the workpiece is tightened or the reverse if loosening is to be accomplished. AS the result of the drive head being repositionable, any combination of angular displacement is easily accomplished without lost motion.

Another object of the invention is directed to a unique locking system that secures the square drive head at a given angle relative to the handle. This feature is particularly useful when the tool is used like a "bull handle" or a so called "L-handle". Further, the arrangement locks the head at equal angular increments, which would be at the most convenient positions. It should also be noted that it is not necessary to lock the head, as it rotates under a small amount of tension and is temporarily held at the angular displacement by a spring-loaded detent so it can be controllable during operation. Locking is easily and intuitively obvious by simply pressing a hinge pin in one direction or the other for positive positioning at the 45 degree increment.

Still another object of the invention is the combination of a rotatable handle and an offset shank in a compact configuration. This coalescence of elements permits the user to use only one hand to rotate the socket easily, whereas conventional ratchets require two hands. Flex handles and the like require removing the socket each time the rotational limit is reached. Conventional speeder handles are long and have limited utility as unrestricted space is essential to their function. In contrast, the instant invention is compact and may be used in most places or conventional ratchet handle is normally employed utilizing both the speeder handles quickness and the ratchets usefulness.

Yet another object of the invention is realized in the second embodiment wherein a second head is used, similar in function, only connecting the shank to the handle wherein the shank may be changed in its angular alignment relative to the handle. This embodiment is particularly useful in areas that are tight and hard to reach with conventional straight or fixed angle tools. It may be plainly seen that the use of another head permits the handle to be positioned independent of the square drive head therefore as many as five additional angles may be used in attempting to find the most practical approach to loosening or tightening a fastener even under the most difficult circumstances.

Still another object of the second embodiment of the invention is the feature that permits the wrench to be positioned in crank fashion with the handle vertical along with the square drive head. This unique position allows the fastener to be rotated like a crank handle with the shank horizontal or angled 180, 90 or 45 degrees while still retaining the ability to be rotated as described above in certain combinations of angles.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
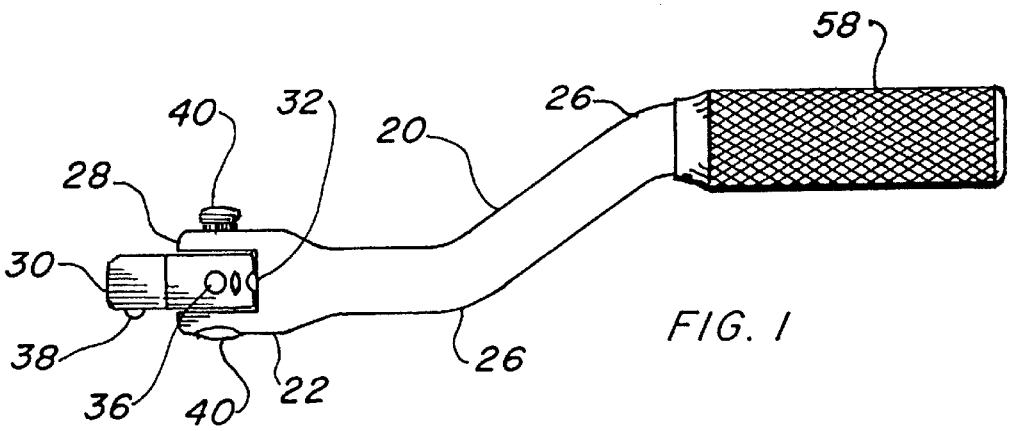
FIG. 1 is a plan view of the preferred embodiment.
Figure 2:
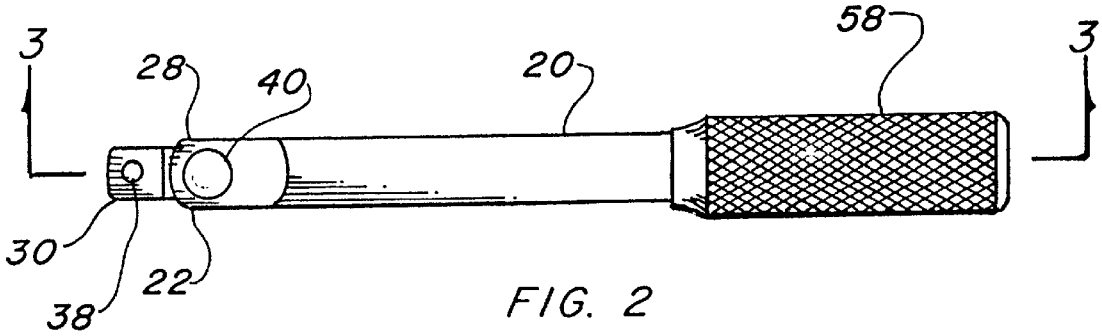
FIG. 2 is a side view Of the preferred embodiment.
Figure 3:
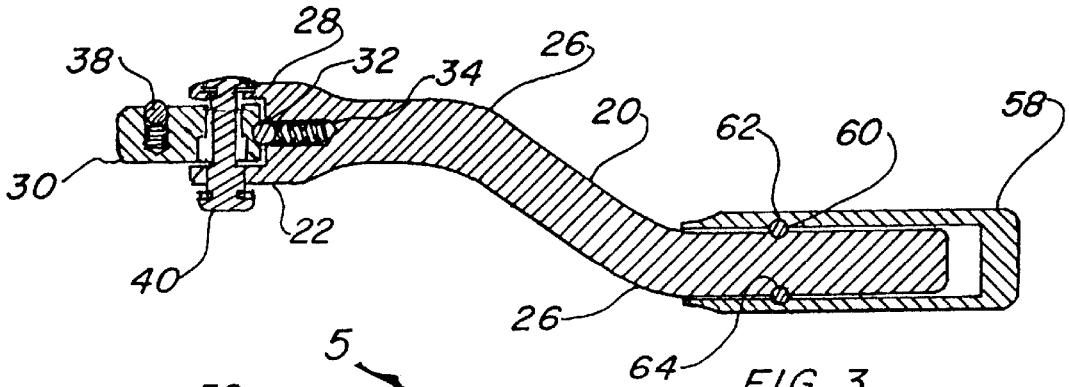
FIG. 3 is a cross-sectional view taken along lines 3—3 of FIG. 2 illustrating the internal structure Of the invention.

The best mode for carrying out the invention is presented in terms of a preferred and a embodiment. Both are alike except the second embodiment has an additional pivoting head on the end of the offset shank adjacent to the handle. The preferred embodiment, as shown in FIGS. 1 through 12, is comprised of an offset shank 20 that may be round in shape, made of metal and having a first end 22 and a second end 24. The shank 20 is illustrated assembled in FIGS. 1–3 and by itself in the exploded view of FIG. 12. The shank 20 has two opposed bends 26 that are integrally formed or forged during fabrication. The bends 26 are of equal angles from 10 degrees to 90 degrees, with 45 degrees being preferred, and the first end 22 and second end 24 are parallel in each opposed direction, as illustrated in FIGS. 1, 3 and 12.

A clevis 28 is integrally formed into the first end 22 of the shank, thus forming a bifurcated fork, as illustrated best in FIG. 12.

Figure 4:
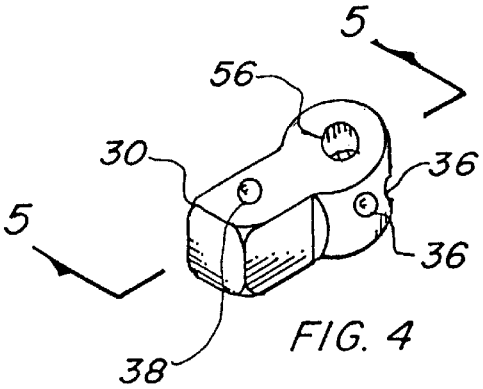
FIG. 4 is a partial isometric view of the square drive head completely removed from the invention for clarity.
Figure 5:
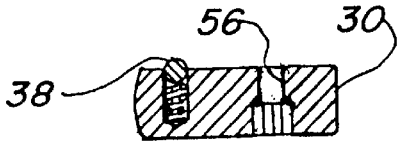
FIG. 5 is a cross-sectional view taken along lines 5—5 of FIG. 4.
Figure 6:
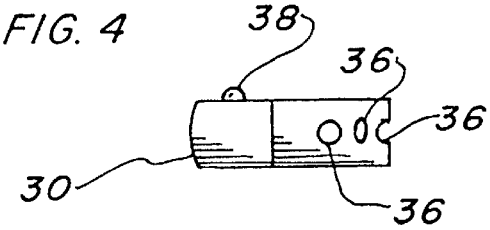
FIG. 6 is a side view Of the square drive head completely removed from the invention for clarity.

A square drive head 30 is pivotally disposed within the shank first end 22 and is configured to accept wrench sockets. Preferably, the drive head 30 is sized to fit a conventional ¼ inch, ⅜ inch and ½ inch drive however, other sizes may be included and used with equal ease, such as metric sizes. The drive head 30 is depicted alone in FIGS. 4–6 and its assembly into the clevis 28 incorporates an angular position retaining means which comprises means to intersect rotation at least five discrete positions with a total displacement of 180 degrees, as defined by the utilization of a spring-loaded detent ball 32. The ball 32 is located within a bore 34 in the bifurcated fork and the drive head 30 contains a plurality of depressions 36 at coequal spacing with 45 degrees being preferred, as illustrated in FIGS. 4, 6 and 12, however any number of equal spaces may be employed with like ease and utility. The detent ball 32 intersects with the depressions 36 holding the drive head 30 in specific angular positions however only sufficient to hold it in place when in steady not active state. It is also easily adjusted by hand when another angle is desired. It should be noted that the drive head 30 also contains a spring-loaded drive detent 38 for holding sockets in place, which is well known in the art and in common usage.

The drive head 30 is held rotatably between the jaws of the forked clevis 28 with a slidable hinge pin 40, thereby permitting the drive head to pivotally rotate and lock within the confines of the clevis 28. Securement means to hold the hinge pin 40 in position from sliding from one side to the other is provided by the lateral urging of the spring loaded detent ball 32 as constant pressure is brought to bare by the spring.

Figure 7:
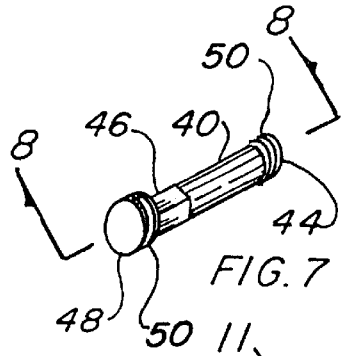
FIG. 7 is a partial isometric view of the hinge pin completely removed from the invention for clarity.
Figure 8:
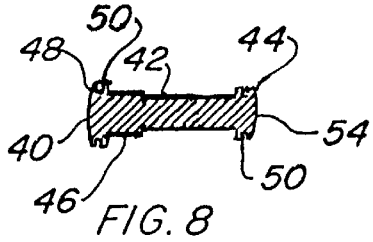
FIG. 8 is a cross-sectional view taken along lines 8—8 of FIG. 7.

The hinge pin 40 is shown removed from the invention for clarity in FIGS. 7 and 8 and consists of a round body 42 with a body head 44 only slightly larger in diameter than the body and a square or polygonal shaped shank 46 integral with the round body. A shank head 48 is integrally formed adjacent to the shank configured considerably larger than the shank. The head 4s is round and is preferably contoured to follow the shape of the outside surface of the clevis 28. Both the body head 44 and the shank head 48 contain a retaining ring groove 50 at the interface of the respective head to the body 42 or shank 46 as illustrated in FIGS. 7 and 8. A flat retaining ring 52 is placed into each of the grooves 50 with the ring in the body head holding the hinge pin 40 in place after assembly. The rings 52 may be of a different diameter and thickness as required for the particular size of drive and end of the pin, however the utility remains the same. When the drive head 30 is installed with the hinge pin 40 only the shank head retaining ring groove 50 receives one of the retaining rings 52, after the pin 40 is brought into the drive head 30 through the clevis 28, the shank head is urged flush into the clevis and the remaining flat retaining ring 52 is inserted into the body head groove 50 permitting the pin to slide freely within the confines of the clevis with either one of the heads 44 or 48 alternately flush with the outside surface of the clevis as desired by the user.

Figure 9:
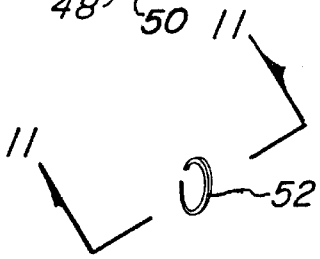
FIG. 9 is a partial isometric view of one of the lock rings.
Figure 10:
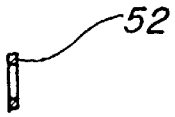
FIG. 10 is a cross sectional view taken along lines 10—10 of FIG. 9.
Figure 11:
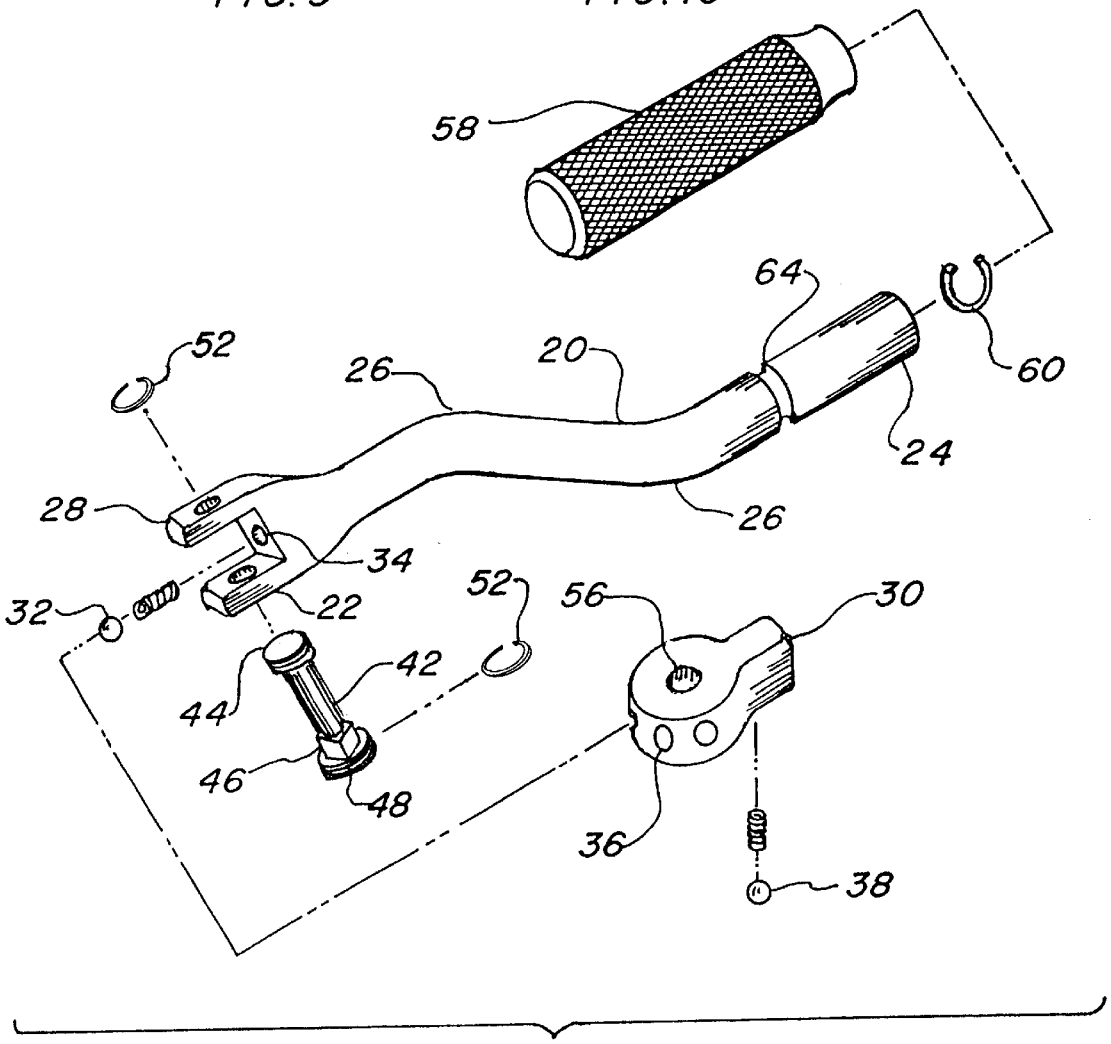
FIG. 11 is an exploded view of the preferred embodiment.
Figure 12:
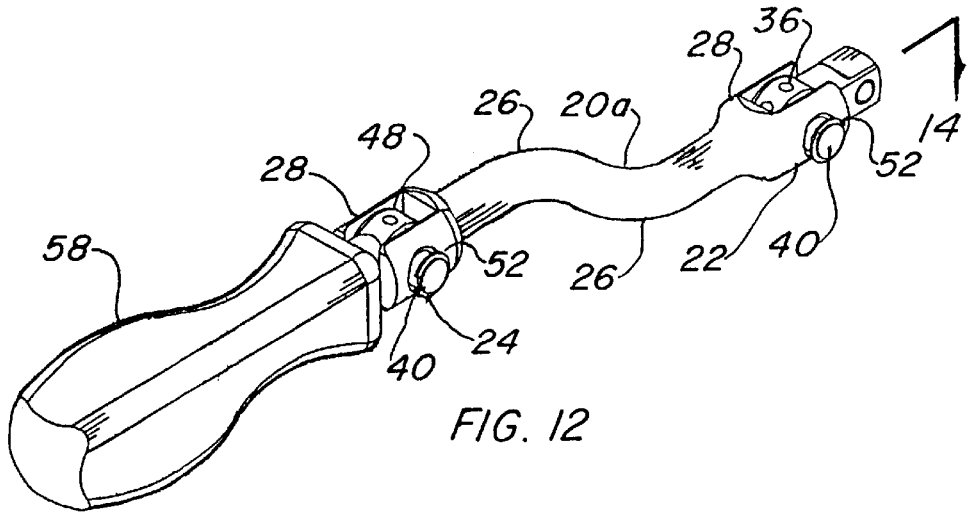
FIG. 12 is a partial isometric view of the second embodiment.
Figure 13:
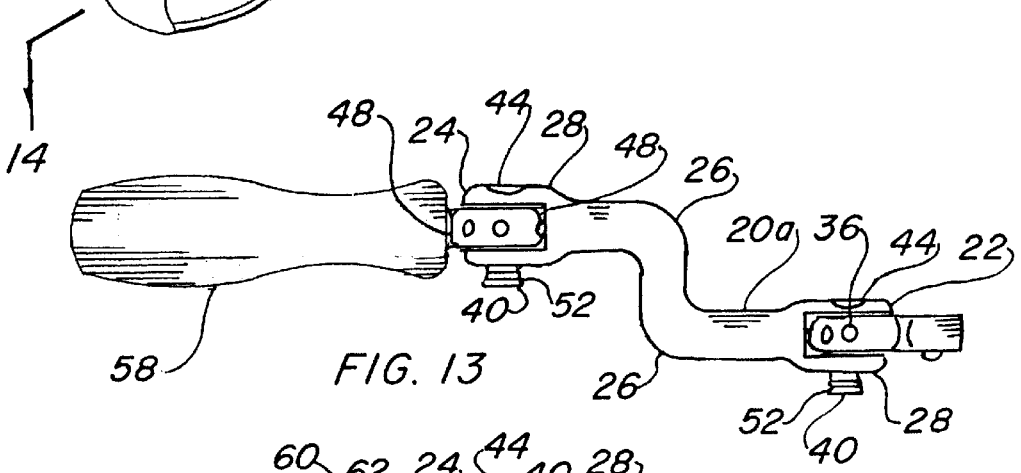
FIG. 13 is a plan view of the second embodiment.

In order to lock the head 30 at one of the angular positions at equal increments, the head 30 includes an octagonal or polygonal depression 56, as depicted in FIGS. 4 and 11. When the hinge pin 40 is manually urged in a first direction, the square drive head 30 is only in communication with the round body 42 of the pin 40, thereby permitting free rotation. When the hinge pin 40 is slid in an opposite second direction, with the flat shank head 48 touching a recess in the clevis 28, the square or polygonal shank 46 of the pin 40 intersects with the octagonal or polygonal depression 56 at the adjoining points, thus locking the drive head 30 in place. The illustrated five positions of the detent ball 32 into the depressions 36 are duplicated by the square or polygonal shank 46, as shown in FIGS. 7–9, into the octagonal depression 56, as shown in FIG. 4, creating a positive lock. Further, the spring-loaded detent ball 32 holds the pin 40 in the position manually set, due to its spring loading feature which creates constant pressure.

It will be noted that five positions of the retaining means are shown employing the spring-loaded detent ball 32 however, the invention is not restricted to this specific number as any number of intervening polygonal depressions 36 may be easily utilized in incremental spacing. Again the drive head securement means is shown in the drawings and described as utilizing a square or polygonal shank 46 and an octagonal or polygonal depression 56 may likewise be easily altered to employ any polygonal shape in both elements thus as long as the depressions have a double amount of facets as that of the shank increasing the number of positions available for the angular displacement of the drive head 30 within the clevis 28, still falling within the bounds of this invention.

A rotatable handle 58 is attached to the second end 24 of the shank 20, thereby permitting rotation of the wrench upon reciprocation of the handle, and radial turning when urged at right angles to the head 30. The handle 58 is rotatably held in place by a round retaining ring 60 which interfaces with an internal groove 62 in the handle and an external groove 64 in the shank 20. These items are well known in the art for attachment of handles to tools. The handle 58 may be cylindrical as shown in FIGS. 1–3 and 11 or contoured as illustrated in FIGS. 12–14 and 17–20.

During use the speed handle may be utilized in two separate ways. First, when fastening a bolt or nut, an appropriate socket is attached and the hinge pin 40 is pushed to the side, with the removable head 52 contiguous with the clevis 28. The workpiece is started on its threads manually or inserted into the socket and rotated by spinning the offset handle in a circular direction. When the workpiece is snug, the tool is pushed downward to a convenient position in a single smooth motion. Tightening is then completed by rotation at the appropriate angle, using the handle as a lever arm. The second method of operation is to lock the drive head 30 in place by manually pushing the pin 40 until the flat head 48 is adjacent to the clevis 28 and using the tool as a flex handle or a bull handle etc.

Figure 14:
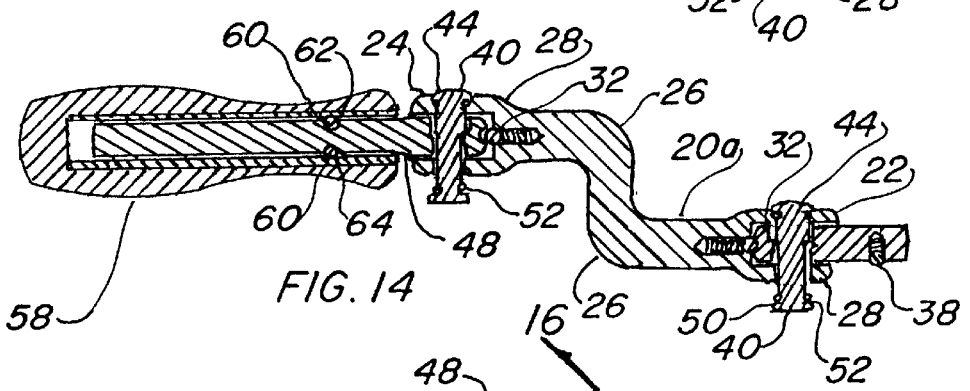
FIG. 14 is a cross sectional view taken along lines 15—15 of FIG. 13.
Figure 15:
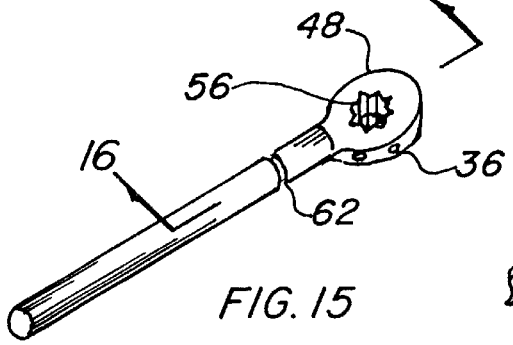
FIG. 15 is a partial isometric view of the second embodiment offset shank.
Figure 16:
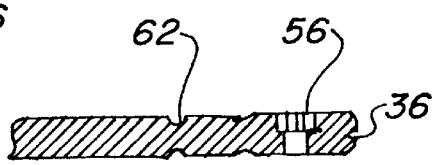
FIG. 16 is a cross sectional view taken along lines 17—17 of FIG. 16.
Figure 17:
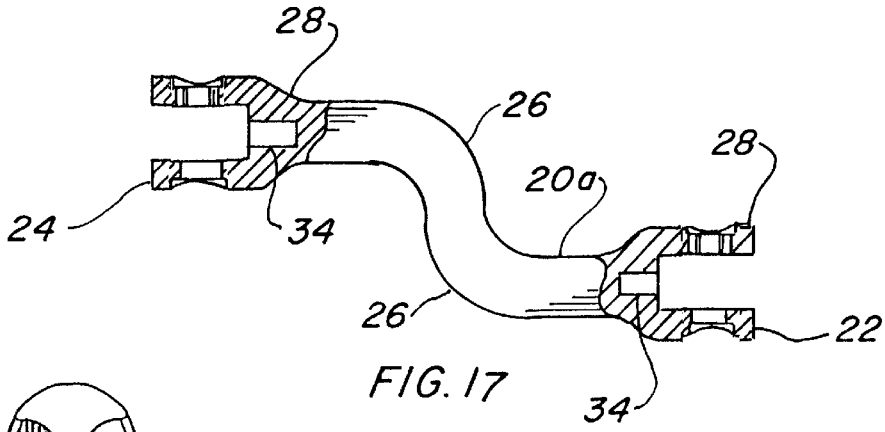
FIG. 17 is a plan view of the second embodiment offset shank with the ends partially cut away for clarity.

The second embodiment of the invention is illustrated in FIGS. 12 through 20 and is basically the same as the preferred embodiment except a second clevis 28 is added to the second end 24 of the offset shank 20*a*. The offset shank 20*a* is shown by itself in FIG. 17 and the clevis 28 is identical however the bends 26 are a full 90 degrees and the overall length is illustrated shorter than the drawings of the preferred embodiment. This difference in configuration bares no weight as it will be noted that the angles may be from 10 to 90 degrees and the length is of little importance as it depends upon the size of the drive and the wrenches ultimate utility. A second head is mounted in the second clevis 28 and is different in this embodiment as it attaches directly to the handle 58 therefore it is designated a body head 44 instead of the first, drive head 30. This body head 44 has the same radial shape and flat sides, including the depressions 36, as the drive head except instead of the square drive end a cylindrical portion extends outwardly and interfaces with the handle 58 in the same manner as the second end 24 of the preferred shank 20 as illustrated in FIG. 14. The cylindrical portion of the head 44 includes an internal groove 62 and interfaces with the same round retaining ring 60 permitting the handle to rotate freely on the head extended portion.

Figure 18:
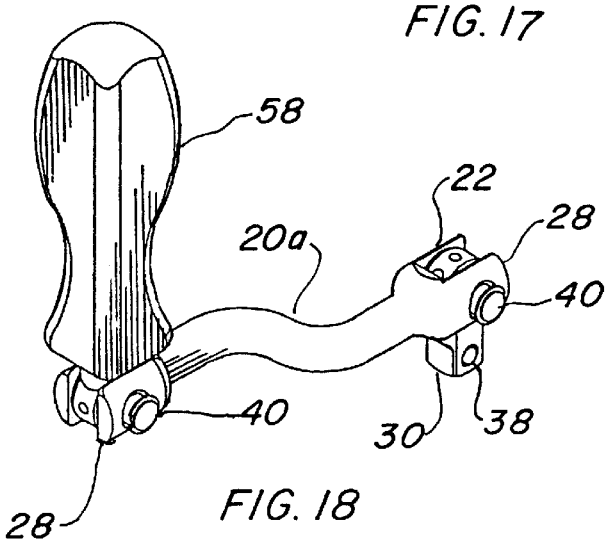
FIG. 18 is a partial isometric view of the second embodiment with the handle adjusted into the vertical position.
Figure 19:
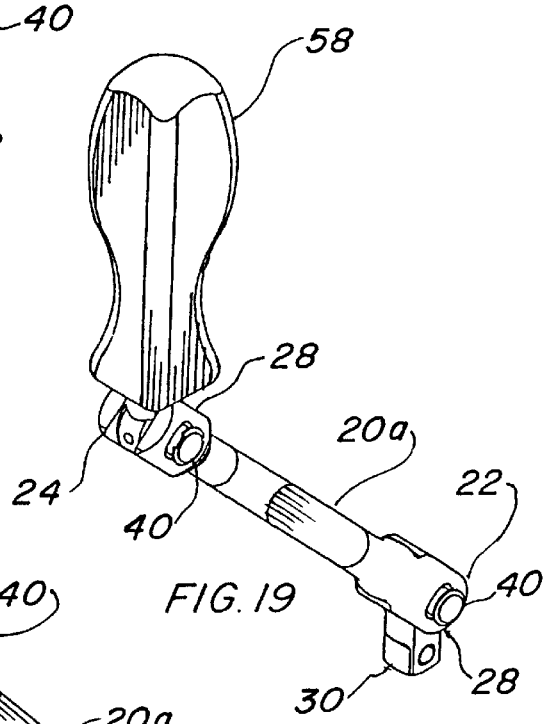
FIG. 19 is a partial isometric view of the second embodiment with the handle adjusted into the vertical position and the shank at a 45 degree angle.
Figure 20:
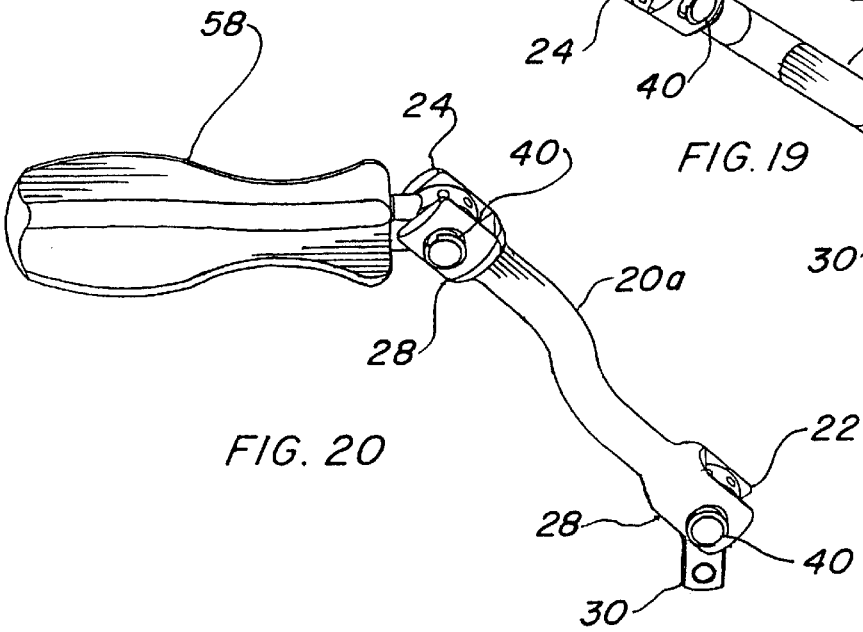
FIG. 20 is a partial isometric view of the second embodiment with the handle adjusted into the horizontal position and the shank at a 45 degree angle.

Since the body head 44 functions in the same manner as the square drive head 30 and the same hinge pin 40 is utilized along with the head detent 38 assuring the angular position of the head the wrench may now have the handle 58 adjusted to the optimum position for leverage and convenience as illustrated in FIGS. 18–20. It will be plainly seen that the utility of the wrench by spinning the offset handle in a circular direction to snug the workpiece is not altered in any way only its usefulness is enhanced by relocating the angle of the handle to best suit the particular circumstance.

For example, the drive head 30 can be attached to one end of a straight rod wherein the rod's opposite end has a T-handle connected which functions as a speed handle for rotating the wrench.

While the invention has been described in complete detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

What is claimed is:

1. A hinged socket wrench speed handle for tool sockets comprising:

a) an offset shank having a first end and a second end, b) a clevis integrally formed into at least one shank end forming at least one bifurcated fork, c) at least one pivoting head disposed within a shank end bifurcated fork with one configured to accept wrench sockets, said head configured to accept wrench sockets defining a square drive head that further includes angular position retaining means to intersect rotation at equal spaced discrete positions comprising a spring loaded detent ball that is disposed within said bifurcated fork, and said square drive head configured to accept wrench sockets having a plurality of depressions at coequal spaces such that the detent ball intersect with the depressions, thus retaining the drive head in a specific position also drive head securement means, d) a hinge pin disposed through at least one head and clevis bifurcated fork thus permitting the head to pivotally rotate and lock within the confines of the clevis, said hinge pin is slideable and held in position by lateral urging of said spring loaded detent ball, and e) a rotatable handle attached to the second end of the shank for rotating the wrench upon reciprocation of the handle, and radial turning when urged at substantially right angles to the pivoted drive head.

2. The hinged socket wrench speed handle as recited in claim 1 wherein said offset shank further comprises a pair of opposed bends integral with the shank.

3. The hinged socket wrench speed handle as recited in claim 2 wherein said opposed bends are at equal angles and the shank first end and second end are parallel thereunto.

4. The hinged socket wrench speed handle as recited in claim 3 wherein said a opposed bends are from 10 degree angles to 90 degree angles and coequal thereunto.

5. The hinged socket wrench speed handle as recited in claim wherein said slidable hinge pin further comprises a round body with a body head and with a polygonal shank, with an integral shank head, and a drive head having an polygonal depression such that when the hinge pin is manually urged in a first direction the drive head is in communication with the round body, thereby permitting free rotation; and when slid in an opposite second direction the polygonal shank of the hinge pin intersects with the polygonal depression, locking the drive head in place.

6. The hinged socket wrench speed handle as recited in claim 1 wherein said square drive head further comprises a ¼ inch drive interface.

7. The hinged socket wrench speed handle as recited in claim 1 wherein said square drive head further comprises a ⅜ inch drive interface.

8. The hinged socket wrench speed handle as recited in claim 1 wherein said square drive head further comprises a ½ inch drive interface.

9. A hinged socket wrench speed handle for tool sockets comprising:

a) an offset shank having a first end and a second end, b) a clevis integrally formed into the shank's first end and shank's second end each forming a bifurcated fork, c) a first head defining a square drive head pivotally disposed within the shank's first end bifurcated fork to accept wrench sockets, d) a second head defining a handle head pivotally disposed within the shank's second end bifurcated fork to accept a handle, e) a hinge pin disposed through both the square drive head and the first end clevis bifurcated fork and the handle head and the second end clevis bifurcated fork thus permitting each head to pivotally rotate and lock within the confines of its respective clevis, and f) a rotatable handle attached to the handle head for rotating the wrench upon reciprocation of the handle, and radial turning when urged at substantially right angles to the pivoted square drive head.

10. The hinged socket wrench speed handle as recited in claim 9 wherein said offset shank further comprises a pair of opposed bends integral with the shank and the bends are at equal angles from 10 degrees to 90 degrees with the shank first end and second end is parallel thereunto.

11. The hinged socket wrench speed handle as recited in claim 9 wherein both square drive head and handle head further comprises angular position retaining means including means to intersect rotation at equal spaced discrete positions and head securement means.

12. The hinged socket wrench speed handle as recited in claim 11 wherein said angular position retaining means further comprises means to intersect rotation at equal spaced discrete positions and drive head securement means.

13. The hinged socket wrench speed handle as recited in claim 12 wherein said means to intersect rotation at equal spaced discrete positions further comprises a spring loaded detent ball that is disposed within said bifurcated fork, and said square drive head having a plurality of depressions at coequal spaces such that the detent ball intersects with the depressions, thus retaining the drive head in a specific position.

14. The hinged socket wrench speed handle as recited in claim 13 wherein said drive head securement means further comprising said hinge pin is slidable and held in position by lateral urging of said spring loaded detent ball.

15. The hinged socket wrench speed handle as recited in claim 14 wherein said slidable hinge pin further comprises a round body with a body head and with a polygonal shank, with an integral shank head, and a drive head having an polygonal depression such that when the hinge pin is manually urged in a first direction the drive head is in communication with the round body, thereby permitting free rotation; and when slid in an opposite second direction the polygonal shank of the hinge pin intersects with the polygonal depression, locking the drive head in place.

* * * * *